United States Patent [19]

Nagashima

[11] Patent Number: 4,682,830

[45] Date of Patent: Jul. 28, 1987

[54] SWITCH TERMINAL

[75] Inventor: Akira Nagashima, Kawasaki, Japan

[73] Assignee: Kioritz Corporation, Tokyo, Japan

[21] Appl. No.: 851,074

[22] Filed: Apr. 8, 1986

Related U.S. Application Data

[63] Continuation of Ser. No. 643,377, Aug. 23, 1984, abandoned.

[30] Foreign Application Priority Data

Aug. 26, 1983 [JP] Japan ..... 58-131842[U]

[51] Int. Cl.[4] ..... H01R 27/00

[52] U.S. Cl. ..... 439/224

[58] Field of Search ..... 339/32 R, 32 M, 33

[56] References Cited

U.S. PATENT DOCUMENTS 1,957,582 5/1934 Elliott ..... 339/33

3,774,303 11/1973 Burkett et al. ..... 30/382

3,844,360 10/1974 Green et al. ..... 173/170

*Primary Examiner*—Gil Weidenfeld

*Assistant Examiner*—Paula A. Austin

*Attorney, Agent, or Firm*—Browdy & Neimark

[57] ABSTRACT

A switch terminal for use in an electrical switch of the type having a conductive stationary contact penetrating through an insulating member. The switch terminal has a plurality of pairs of diametrically opposing holes. The pairs of holes are suitably spaced in the angular direction. In each pair, one of the holes is adapted to receive the stationary contact, while the other is adapted to receive the projection on the insulating member, thereby locating the switch terminal with respect to the insulating member, i.e., to the body of the switch. By a selective use of one of the pairs of holes, it is possible to obtain various orientations of the switch terminal with respect to the switch body.

5 Claims, 3 Drawing Figures

SWITCH TERMINAL

This application is a continuation, of application Ser. No. 643,377, filed Aug. 23, 1984 now abandoned.

BACKGROUND OF THE INVENTION

The present invention relates to a switch terminal.

Various type of equipments use electrical switches. The switches on these equipments are usually oriented in such directions as to facilitate the manipulation by the users. It is desirable that such orientation of the switch also provides the best direction or position of the switch terminal from the view point of easy connection to electric wires. Unfortunately, however, the orientation of the switch optimum for the manipulation is not always compatible with that optimum for the connection of terminal to the electric wires. In other words, it is often experienced that, when a switch is oriented for easy manipulation, the terminal of the switch are positioned unsuitably for the connection of terminal to the electric wires.

This inconveniently requires preparation of switches having the same function but constructed differently, in order to meet both the demand for easy manipulation and the demand for easy wiring connection, constituting a bottle-neck to the standarization and unification of the switch.

SUMMARY OF THE INVENTION

Accordingly, an object of the invention is to provide a switch terminal capable of overcoming the abovedescribed problem of the prior art.

Another object is to provide a switch terminal having a simple construction and easy to manufacture.

To these ends, the invention provides a switch terminal of the type having a pair of diametrically opposing holes, one for receiving a stationary contact penetrating an insulating member of an electrical switch while other receives a projection formed on the insulating member, wherein the improvement comprises that the pair of diametrically opposing holes is arranged in plural at a suitable pitch in the angular direction, so that the stationary contact and the projection can be received by selected one of the pairs of diametrically opposing holes.

According to the invention therefore, it is possible to obtain switches having different orientations of the switch terminal to comply with the demands for switch installation in various orientations, without requiring any addition or modification of the parts.

Consequently, the invention affords a standarization or unification of the switch to attain a higher economy in the production of the equipment incorporating electrical switches, as well as a wider application of the switches. By suitably selecting the number and positions of the hole pairs, it is possible to obtain a switch which can meet the installation requirement in any desired orientation.

The above and other objects, features and advantages of the invention will become clear from the following description of the preferred embodiment when the same is read in conjunction with the accompanying drawings.

DESCRIPTION OF THE PREFERRED EMBODIMENT

A preferred embodiment of the invention will be explained hereinunder with reference to the accompanying drawings.

Figure 1:
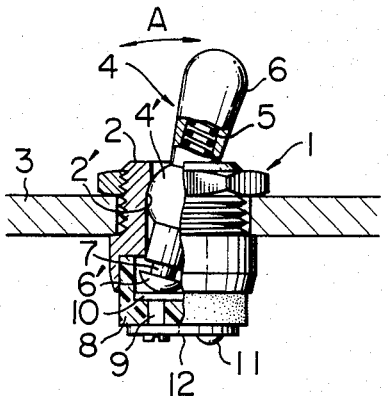
FIG. 1 is a partly-sectioned side elevational view of a switch having switch terminal constructed in accordance with the invention.

Referring first to FIG. 1, an electrical switch suited to use in portable power-driven machines such as a chain saw, grass trimmer, powered sprayer and so forth is generally designated at a reference numeral 1. The switch 1 has a metallic cylindrical body 2 which itself serves as a minus terminal. Namely, the switch body 2 is electrically connected to the associated electric circuit through a stationary frame 3 to which it is secured.

A switch lever 4 is pivotally mounted in the switch body 2. The switch lever 4 has a spherical portion 4' serving as a fulcrum received by a step 2' of a complementary shape formed in the inner surface of the switch body 2 so that the switch lever 4 is swingable as indicated by an arrow A. The upper portion of the switch lever 4 projects outwardly from the switch body 2 such as to constitute a knob 6. The switch lever 4 has an axial bore opening at the lower end of the lever 4. The axial bore receives a compression spring 5 and a plunger 7 which is pressed at its inner end by the compression spring 5 and having an outer end 6' projected outwardly from the lower end of the switch lever 4. The plunger 7 is movable along the axis of the bore. As will be seen from FIG. 1, the outer end 6' of the plunger 7 has a hemispherical form to facilitate the pivotal movement of the switch lever 4.

The bottom of the switch body 2 is closed by a cup-shaped insulating member 8. The insulating member 8 is provided with a conductive pin 9 serving as a stationary contact (plus terminal). The conductive pin 9 penetrates the bottom wall of the insulating member 8 at a position radially offset from the center of the insulating member 8. The pin 9 has a head 10 disposed on the upper surface of the bottom wall of the insulating member 8 so as to be contacted by the outer end 6' of the plunger 7 when the switch lever 4 takes the position shown in FIG. 1, i.e., a switch "on" position.

Figure 2:
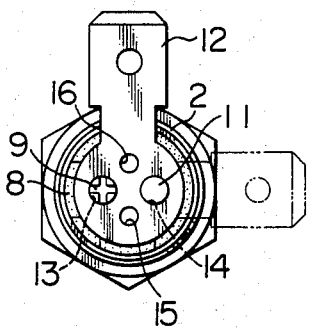
FIG. 2 is a bottom plan view of a switch as shown in FIG. 1.

As shown in FIG. 2, a projection 11 is formed on the outer surface of the bottom wall of the insulating member 8 diametrically opposing to the pin 9.

A switch terminal 12 is attached to the outer surface of the bottom wall of the insulating member 8. The switch terminal 12 is punched out from a conductive thin plate into the form as shown in FIG. 2. A pair of holes 13 and 14 formed in the switch terminal 12 receive the pin 9 and the projection 11 thereby locating the switch terminal 12 with respect to the insulating member 8. The end of the pin 9 is caulked onto the surface of the switch terminal 12 so that the switch terminal 12 is fixed to the insulating member 8. Although in the illustrated embodiment the end of the projection 11 is also caulked, the fixing of the terminal member 12 is usually made by the caulking of the pin 9 solely.

The switch terminal 12 is provided with another pair of diametrically opposing holes 15 and 16. These holes 15 and 16 have the same shape as the holes 13 and 14, and are spaced from each other by the same distance as that between the holes 13 and 14. Assuming a first line which connects the centers of the holes 13 and 14, the holes 15 and 16 are formed on a second line which crosses the first line perpendicularly at the mid point of the first line.

Therefore, when required by the circumstance, the switch terminal 12 can be oriented at a 90° deviation from the first position, as shown by two-dot chain line in FIG. 2. This orientation of the switch terminal 12 can be achieved simply by placing the switch terminal 12 such that the projection 11 and the pin 9 on the insulating member 8 are received by the hole 16 and 15 in the switch terminal 12 and caulking the end of the pin 9 on the insulating member 8.

The switch terminal 12 is electrically connected to the electric circuit during the use. Therefore, when the switch 1 takes the switch "on" position as shown in FIG. 1, the electric current flows through the switch terminal 12, pin 9, plunger member 7, switch lever 4, switch body 2 and the frame 3.

Figure 3:
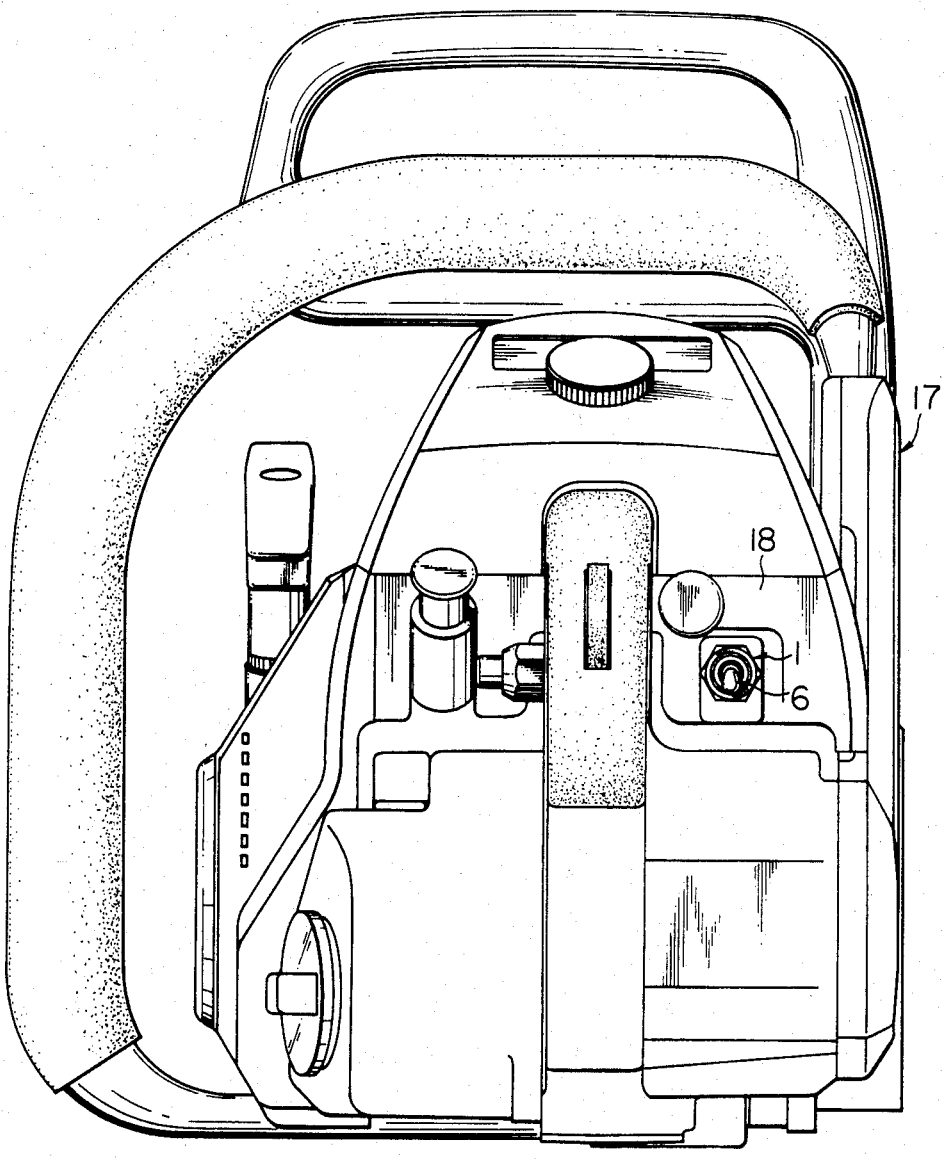
FIG. 3 is a rear elevational view of a chain saw equipped with the switch shown in FIGS. 1 and 2.

FIG. 3 illustrates an application of the switch 1 having the switch terminal 12 in accordance with the invention. In this application, the switch 1 is attached to the frame 18 of a power-driven chain saw 17, such that the knob 6 of the switch 1 can be manipulated up and down as viewed in FIG. 3. In this case, the switch 1 can meet both the demand for easy manipulation and the demand for easy connection of the terminal to electric wires laid on the frame 18 of the chain saw 17. When, however, the switch 1 is mounted on another type of chain saw in which the position of the electric wire is orthogonally offset from that of the chain saw shown in FIG. 3, the switch 1 can be modified to meet such a use simply by a 90° rotation of the switch terminal 12 to the position shown by two-dot chain line in FIG. 2.

What is claimed is:

1. A switching terminal comprising a cup-shaped insulating member;

a rotatable switch terminal member located on said insulating member and having means extending outwardly therefrom for electrically connecting said terminal member to an electric circuit;

means to obtain different orientations of said terminal member including said switch terminal member having a first pair of diametrically opposing holes and a second pair of diametrically opposing holes spaced in an angular direction of approximately 90° from said first part of holes, a stationary contact penetrating said insulating member through one hole of said pair of holes and electrically connected to said means for electrically connecting said switch terminal member to an electric circuit by way of said switch terminal member, a projection formed on said insulating member through the other one hole of the same said pair of diametrically opposing holes;

a spring biased plunger on the opposite side of said cup shaped insulating member positioned to contact said stationary contact when the switching terminal is in a conducting position;

and means to complete the electrical circuitry of the switching terminal from said spring biased plunger whereby said stationary contact and said projection can be received by a selected one of said pairs of diametrically opposing holes to obtain different orientations of said terminal member relative to said insulating member and a line of direction of operation of said plunger.

2. The switching terminal of claim 1 further comprising said switch terminal member including a conductive thin plate.

3. The switching terminal of claim 1 further comprising a knob having a spherical portion;

said spring biased plunger mounted on said knob.

4. The switching terminal of claim 3 further comprising said means to complete the electrical circuitry including a cylindrical member fitted to said cup-shaped insulating member and configured to fit into a supporting frame for supporting the switching terminal;

said spherical portion fitted into and movable in said cylindrical member.

5. The switching terminal of claim 3 further comprising said spring biased plunger having a hemispherical form on its outer end.

* * * * *